US011525448B2

(12) United States Patent
Brown et al.

(10) Patent No.: US 11,525,448 B2
(45) Date of Patent: Dec. 13, 2022

(54) DENSITY GAS SEPARATION APPARTUS FOR ELECTRIC SUBMERSIBLE PUMPS

(71) Applicant: Halliburton Energy Services, Inc., Houston, TX (US)

(72) Inventors: Donn J. Brown, Broken Arrow, OK (US); Michael L. Fripp, Carrollton, TX (US); Stephen M. Greci, Little Elm, TX (US); Richard D. Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 461 days.

(21) Appl. No.: 16/614,611

(22) PCT Filed: Nov. 15, 2019

(86) PCT No.: PCT/US2019/061738
§ 371 (c)(1),
(2) Date: Nov. 18, 2019

(87) PCT Pub. No.: WO2021/096531
PCT Pub. Date: May 20, 2021

(65) Prior Publication Data

US 2021/0363998 A1 Nov. 25, 2021

(51) Int. Cl.
*F04D 13/06* (2006.01)
*E21B 43/38* (2006.01)
(Continued)

(52) U.S. Cl.
CPC ..... *F04D 15/0005* (2013.01); *E21B 43/128* (2013.01); *E21B 43/38* (2013.01); *F04D 13/06* (2013.01); *F04D 13/12* (2013.01)

(58) Field of Classification Search
CPC ..... E21B 43/38; E21B 43/128
See application file for complete search history.

(56) References Cited

U.S. PATENT DOCUMENTS 5,501,580 A * 3/1996 Barrus ..... E21B 43/128 166/107
6,457,531 B1 * 10/2002 Bangash ..... E21B 43/385 166/105

(Continued)

FOREIGN PATENT DOCUMENTS

WO 2018093516 A1 5/2018
WO 2019078821 A1 4/2019
WO 2019135814 A1 7/2019

OTHER PUBLICATIONS

Foreign Communication from Related Application—Gulf Cooperation Council Examination Report, International Application No. GC 2020-40427, dated Aug. 9, 2021, 6 pages.

(Continued)

*Primary Examiner* — Blake Michener
(74) *Attorney, Agent, or Firm* — Conley Rose, P.C.; Rodney B. Carroll

(57) ABSTRACT

A system includes an electric submersible pump (ESP) configured for pumping fluid through a flow path. An autonomous inflow control device (AICD) is included in fluid communication with the flow path to separate one of gas or liquid out of the flow path. A method includes producing liquid from a wellbore using an electric submersible pump (ESP) in the wellbore. The method includes bypassing gas from a headspace the wellbore using an autonomous inflow control device (AICD) to prevent gas locking the ESP.

25 Claims, 2 Drawing Sheets

(51) Int. Cl.

| | |
|---|---|
| ***E21B 43/12*** | (2006.01) |
| ***F04D 15/00*** | (2006.01) |
| ***F04D 13/12*** | (2006.01) |

(56) References Cited

U.S. PATENT DOCUMENTS

| | | | | |
|---|---|---|---|---|
| 6,598,681 | B1 * | 7/2003 | Berry | E21B 43/128 166/62 |
| 7,461,692 | B1 | 12/2008 | Wang | |
| 10,619,435 | B2 * | 4/2020 | Greci | E21B 43/12 |
| 2002/0023750 | A1 | 2/2002 | Lopes et al. | |
| 2009/0151928 | A1 * | 6/2009 | Lawson | F04D 31/00 96/216 |
| 2011/0186300 | A1 * | 8/2011 | Dykstra | F15C 1/16 138/40 |
| 2013/0160990 | A1 * | 6/2013 | Dykstra | E21B 34/08 166/162 |
| 2014/0377080 | A1 * | 12/2014 | Xiao | F04B 47/02 417/430 |
| 2018/0003022 | A1 | 1/2018 | Grande, III et al. | |
| 2018/0106137 | A1 * | 4/2018 | Frosell | E21B 43/12 |
| 2018/0283155 | A1 | 10/2018 | Saponja et al. | |
| 2018/0306019 | A1 | 10/2018 | Saponja et al. | |
| 2019/0063182 | A1 * | 2/2019 | Fripp | E21B 43/12 |
| 2020/0291745 | A1 * | 9/2020 | Greci | F16K 31/18 |
| 2020/0308927 | A1 * | 10/2020 | Fripp | F16K 31/30 |
| 2022/0195836 | A1 * | 6/2022 | Glaesman | E21B 34/06 |

OTHER PUBLICATIONS

Foreign Communication from Related Application—International Search Report and Written Opinion of the International Searching Authority, International Application No. PCT/US2019/061738, dated Nov. 15, 2019, 10 pages.

* cited by examiner

DENSITY GAS SEPARATION APPARTUS FOR ELECTRIC SUBMERSIBLE PUMPS

COSS-REFERENCE TO RELATED APPLICATIONS

This is a national stage application under 35 U.S.C. § 371 claiming priority to International Patent Application No. PCT/US2019/061738 filed Nov. 15, 2019 which is incorporated by reference herein in its entirety.

BACKGROUND

1. Field

The present disclosure relates generally to devices for use in controlling fluid flow. More specifically, but not by way of limitation, this disclosure relates to density-based fluid flow control devices.

2. Description of Related Art

Production tubing and other equipment can be installed in a wellbore of a well system (e.g., an oil or gas well) for communicating fluid in the wellbore to the well surface. The resulting fluid at the well surface is referred to as production fluid. Production fluid can include a mix of different fluid components, such as oil, water, and gas, and the ratio of the fluid components in the production fluid can change over time. This can make it challenging for a well operator to control which types of fluid components are produced from the wellbore. For example, it can be challenging for a well operator to produce mostly oil from the wellbore, while reducing or eliminating the production of gas or water from the wellbore.

The conventional techniques have been considered satisfactory for their intended purpose. However, there is an ever present need for improved fluid flow control devices. This disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
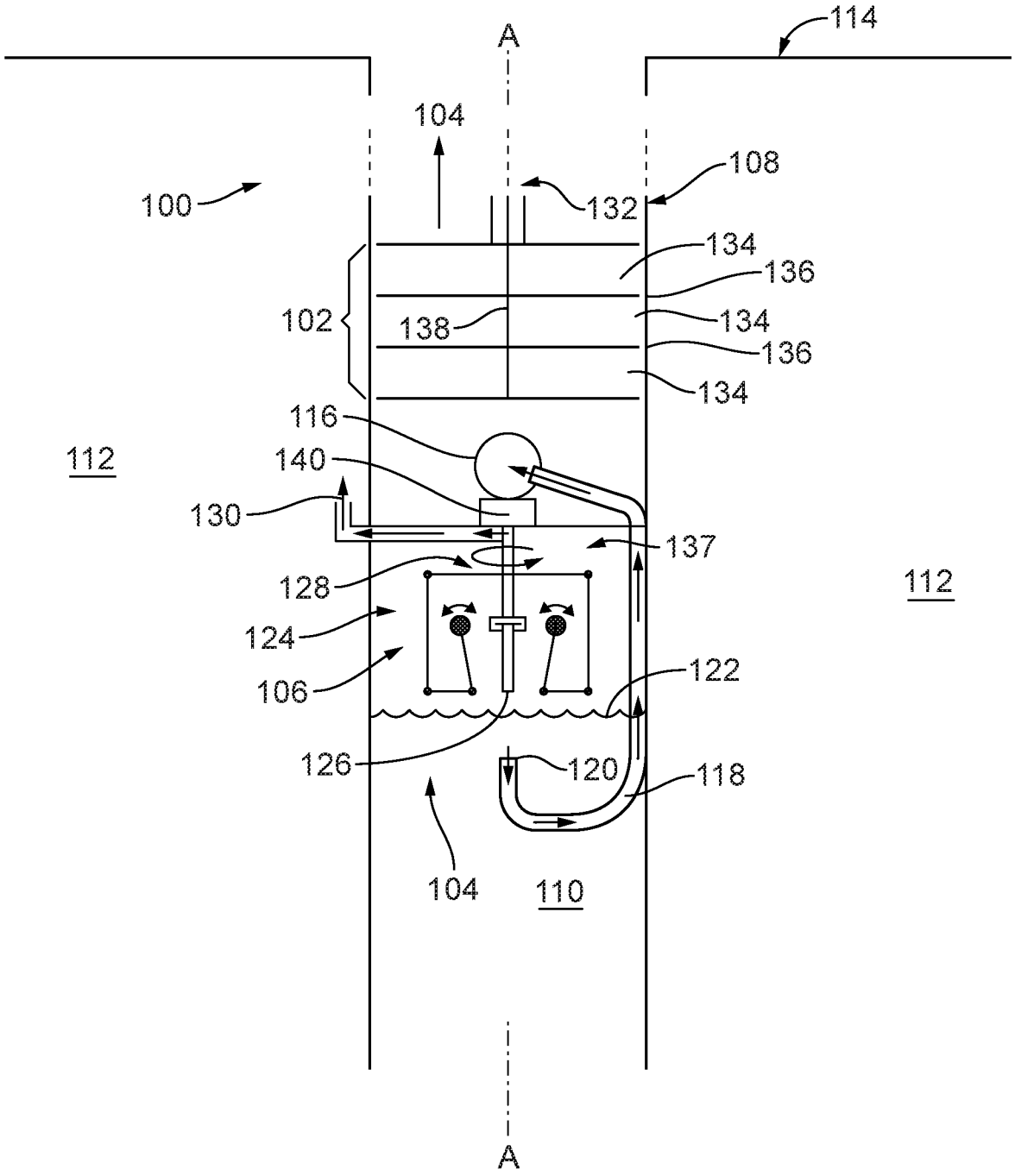
FIG. 1 is a schematic side elevation view of an embodiment of a system constructed in accordance with the present disclosure, showing the system in a wellbore.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-3, as will be described. The systems and methods described herein can be used for density based gas separation for electric submerged pumps (ESPs).

The system 100 includes an electric submersible pump (ESP) 102 configured for pumping fluid through a flow path 104. An autonomous inflow control device (AICD) 106 is included in fluid communication with the flow path 104 to facilitate the separation one of gas or liquid out of the flow path 104 by at least partially restricting one of gas or liquid flow in the flow path 104. The flow path 104 and ESP can be in a wellbore 108, wherein the ESP 102 and flow path 104 are connected in fluid communication to drive flow of production fluids 110, e.g., liquids 110, from a formation 112 in which the wellbore 108 is formed, to a surface 114 of the wellbore 108. The ESP 102 has a pump inlet 116 in the flow path 104. A dip tube 118 extending from the pump inlet 116 downward to an inlet 120 of the dip tube 118 that is below a liquid level 122 in the wellbore 108.

The wellbore 108 includes a headspace 124 above the liquid level 122 and below the pump inlet 116. The ACID 106 can be positioned in the headspace 124. An inlet 126 of the AICD 106 below an outlet 128 of the AICD 106. The AICD 106 can be configured to vent gas from the headspace 124 to the surface 114 through a bypass stream 130 that bypasses the ESP 102, and to inhibit liquids entering the bypass stream 130. This can help to prevent gas locking the ESP 102.

The ESP 102 includes a discharge outlet 132 in the flow path 104 downstream of the inlet 116 of the ESP 102. The AICD 106 is in the flow path 104 upstream of the inlet 116 of the ESP. However, it is also contemplated that in addition to or in lieu of the AICD 106 upstream of the inlet 116 of the ESP, an AICD 106 can be included in the flow path 104 downstream of the outlet 132 of the ESP, e.g. with the purpose of removing gas, dropping the pressure for gas relieve, and/or reducing risk of gas locking the ESP 102 with pressurized gas above the ESP 102. The ESP 102 can include one or multiple stages 134 connected together in series in the flow path 104. It is also contemplated that in addition to or in lieu of multiple stages 134, multiple ESPs 102 can be connected in series in the flow path 104. The AICD 106 can be positioned in the flow path 104 in series between the two stages 134 or ESPs 102, e.g., in the positions 136 indicated in FIG. 1. Thus one or more AICDs 106 can be included in any or all of the positions in series upstream, downstream, or between the stages 134 or between ESPs 102 (if multiple ESPs 102 are used). Those skilled in the art will readily appreciate that while three stages 134 (or individual ESPs 102) are shown in FIG. 1, any suitable number of stages 134, ESPs 102, and AICDs 106 can be used without departing from the scope of this disclosure.

The AICD 106 rotates at the same or a different speed from the ESP 102, as indicated by the rotation arrow 137, about a rotation axis of the AICD 106 which is aligned parallel to the wellbore axis A. For example, the ESP 102 can include a rotary shaft 138, wherein the AICD 106 is mechanically connected to the rotary shaft 138 to drive rotation of the AICD 106 by power of the ESP 102 at the same speed as the ESP 102. Optionally a gearbox 140 can mechanically connect the rotary shaft 138 to the AICD 106, wherein the gearbox 140 is configured to drive the AICD 106 at a higher RPM rate than the rotary shaft 138 of the ESP 102. It is also contemplated that the AICD 106 can be rotationally independent of the ESP 102. For example, the AICD 106 can include a set of rotary fins 142, shown in FIG.

2, exposed to the flow path 104, labeled in FIG. 1, for driving rotation of the AICD 106 in response to fluid flow through the flow path 104.

Figure 2:
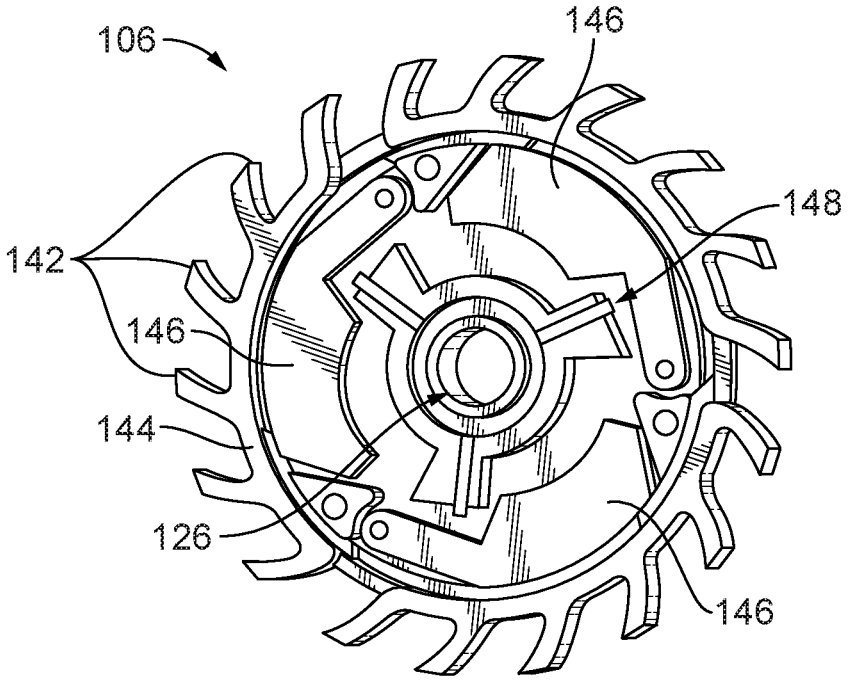
FIG. 2 is a cross-sectional axial end view of a portion of the system of FIG. 1, showing autonomous inflow control device (AICD) with valves openings unoccluded.
Figure 3:
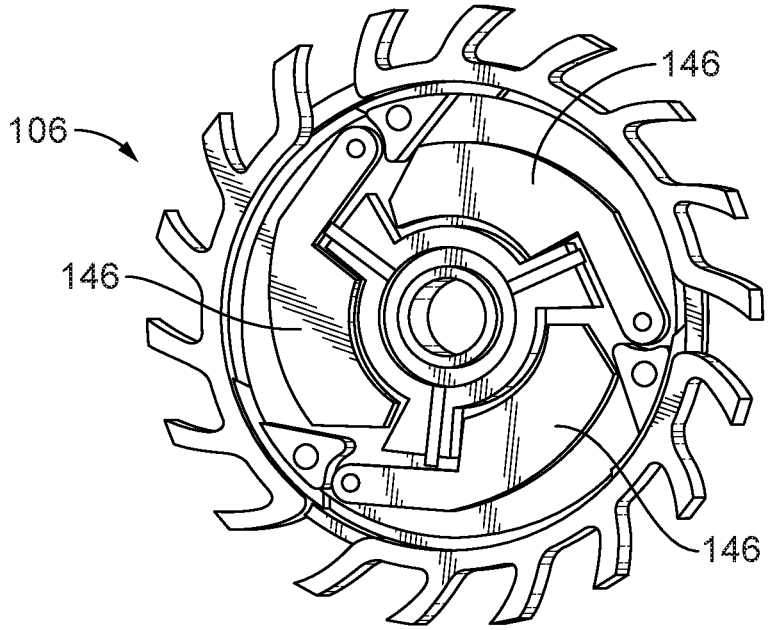
FIG. 3 is a cross-sectional axial end view of the system of FIG. 2, showing the valve openings occluded.

With continued reference to FIG. 2, the AICD 106 can include a housing 144 with at least one float member 146. In FIGS. 2-3, there are three float members 146. Each float member 146 is arranged there a respective valve opening 148 in the housing 144. Each float member 146 is hingedly connected to the housing 144 so as to occlude the respective valve opening 148 or unocclude the valve opening 148 based on fluid density of fluid flowing through the AICD 106 under buoyancy from centrifugal forces from rotation of the float members 146 and fluids within the AICD 106. In this manner, in the absence of gas within the housing 144 of the AICD 106, the float members 146 impede liquid flow through the valve opening, and unocclude the valve openings 148 in the presence of gas within the housing 144 to vent gas through the valve openings 148 and thereby divert the gas from the flow path 104 (of FIG. 1) out the bypass 130 (of FIG. 1) and avoid gas lock interruption of the ESP 102. The AICD 106 can thus be rotated to generate centrifugal forces for discriminating between liquid and gas. Additional information about AICDs is provided in International Patent Application Publication No. WO2019/135814, the contents of which are incorporated by reference herein in their entirety.

Those skilled in the art having the benefit of this disclosure will readily appreciate that the scope of this disclosure is not limited to any specific type of AICD or other device that restricts the flow of a lower viscosity fluid and has attenuated restriction to the flow of a higher viscosity fluid. For example, the term AICD can includes devices that have a fluidic vortex such as are provided by Halliburton of Houston, Tex. under the trade name Equiflow® Autonomous Inflow Control Device.

Accordingly, as set forth above, the embodiments disclosed herein may be implemented in a number of ways. For example, in general, in one aspect, the disclosed embodiments relate to a system. The system includes an electric submersible pump (ESP) configured for pumping fluid through a flow path. An autonomous inflow control device (AICD) is included in fluid communication with the flow path configured to at least partially restrict one of gas or liquid flow in the flow path.

In general, in another aspect, a method includes producing liquid from a wellbore using an electric submersible pump (ESP) in the wellbore. The method includes bypassing gas from a headspace the wellbore using an autonomous inflow control devices (AICD) to prevent gas locking the ESP.

In another aspect, the ESP can include an inlet in fluid communication with the flow path, and an outlet in the flow path downstream of the inlet, wherein the AICD is in the flow path upstream of the inlet. It is also contemplated that the ESP can include an inlet in fluid communication with the flow path, and a discharge outlet in the flow path downstream of the inlet, wherein the AICD is in the flow path downstream of the outlet to remove gas or drop the pressure for gas relief.

In another aspect, the ESP can include at least two stages connected together in series in the flow path, wherein the AICD is in the flow path in series between the two stages. The AICD can be a first AICD, a second AICD can be connected in series in the flow path with the two stages, wherein the first AICD is in series between the two stages, and wherein the second AICD is in series upstream or downstream of the two stages.

In another aspect, the ESP can be a first ESP, and a second ESP can be connected in series with the first ESP, wherein the AICD is connected in series between the first and second ESPs. The AICD can be a first AICD and a second AICD can be connected in series in the flow path with the first and second ESPs, wherein the first AICD is in series between the first and second ESPs, and wherein the second AICD is in series upstream or downstream of the first and second ESPs.

In another aspect, the AICD can rotate at the same or a different speed from the ESP. The ESP can include a rotary shaft, wherein the AICD is mechanically connected to the rotary shaft to drive rotation of the AICD by power of the ESP. A gearbox can mechanically connect the rotary shaft to the AICD, wherein the gearbox is configured to drive the AICD at a higher RPM rate than the rotary shaft of the ESP. It is also contemplated that the AICD can be rotationally independent of the ESP. The AICD can include a set of rotary fins exposed to the flow path for driving rotation of the AICD in response to fluid flow through the flow path.

In another aspect, the AICD can include at least one float member and a valve opening, wherein the float member is connected to occlude the valve opening or unocclude the valve opening based on fluid density of fluid flowing through the AICD under centrifugal forces from rotation of the float member within the AICD. The float member can be configured to occlude the valve opening in the absence of gas within a housing of the AICD, impeding liquid flow through the valve opening, and to unocclude the valve opening in the presence of gas within the housing to vent gas through the valve opening and thereby divert the gas from the flow path and avoid gas lock interruption of the ESP.

In another aspect, the flow path can be in a wellbore, wherein the ESP and flow path are connected to drive flow of production fluids from a formation in which the wellbore is formed, to a surface of the wellbore. The wellbore can include the ESP therein, with a pump inlet in the flow path, and with a dip tube extending from the pump inlet downward to an inlet of the dip tube below a liquid level in the wellbore.

In another aspect, the wellbore can include a headspace above the liquid level and below the pump inlet. The ACID can be positioned in the headspace, with an inlet of the AICD below an outlet of the AICD. The AICD can be configured to vent gas from the headspace to the surface through a bypass stream that bypasses the ESP, and to inhibit liquids entering the bypass stream. The AICD can include at least one float within a housing of the AICD, wherein the at least one float is configured to rotate about a rotation axis of the AICD which is aligned parallel to the wellbore. The AICD can be rotated to generate centrifugal forces for discriminating between liquid and gas.

The methods and systems of the present disclosure, as described above and shown in the drawings, provide for density based gas separation for electric submerged pumps (ESPs). While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising:

an electric submersible pump (ESP) configured for pumping fluid through a flow path, wherein the ESP includes a rotary shaft; and an autonomous inflow control device (AICD) comprising a set of rotary fins in fluid communication with the flow path configured to at least partially restrict one of gas or liquid flow in the flow path, wherein the AICD is independent of the rotary shaft, and wherein the set of rotary fins are exposed to the flow path for driving rotation of the AICD in response to fluid flow through the flow path.

2. The system as recited in claim 1, wherein the ESP includes an inlet in fluid communication with the flow path, and an outlet in the flow path downstream of the inlet, wherein the AICD is in the flow path upstream of the inlet.

3. The system as recited in claim 1, wherein the ESP includes an inlet in fluid communication with the flow path, and a discharge outlet in the flow path downstream of the inlet, wherein the AICD is in the flow path downstream of the outlet to remove gas or drop the pressure for gas relief.

4. The system as recited in claim 1, wherein the ESP includes at least two stages connected together in series in the flow path, wherein the AICD is in the flow path in series between the two stages.

5. The system as recited in claim 4, wherein the AICD is a first AICD, and further comprising a second AICD connected in series in the flow path with the two stages, wherein the first AICD is in series between the two stages, and wherein the second AICD is in series upstream or downstream of the two stages.

6. The system as recited in claim 1, wherein the ESP is a first ESP, further comprising a second ESP connected in series with the first ESP, wherein the AICD is connected in series between the first and second ESPs.

7. The system as recited in claim 6, wherein the AICD is a first AICD and further comprising a second AICD connected in series in the flow path with the first and second ESPs, wherein the first AICD is in series between the first and second ESPs, and wherein the second AICD is in series upstream or downstream of the first and second ESPs.

8. The system as recited in claim 1, wherein the flow path is in a wellbore, wherein the ESP and flow path are connected to drive flow of production fluids from a formation in which the well bore is formed, to a surface of the wellbore.

9. The system as recited in claim 8, wherein the wellbore includes the ESP therein, with a pump inlet in the flow path, with a dip tube extending from the pump inlet downward to an inlet of the dip tube below a liquid level in the well bore.

10. The system as recited in claim 9, wherein the wellbore includes a headspace above the liquid level and below the pump inlet, wherein the AICD is positioned in the headspace, with an inlet of the AICD below an outlet of the AICD, wherein the AICD is configured to vent gas from the headspace to the surface through a bypass stream that bypasses the ESP, and to inhibit liquids entering the bypass stream.

11. The system as recited in claim 10, wherein the AICD includes at least one float within a housing of the AICD, wherein the at least one float is configured to rotate about a rotation axis of the AICD which is aligned parallel to the wellbore.

12. A method comprising:

producing liquid from a wellbore through a flow path using an electric submersible pump (ESP) in the wellbore, wherein the ESP includes a rotary shaft;

driving rotation of an autonomous inflow control device (AICD) in response to fluid flowing through the flow path; and bypassing gas from a headspace in the wellbore using the AICD to prevent gas locking the ESP, wherein the AICD comprises a set of rotary fins in fluid communication with the flow path configured to at least partially restrict one of gas or liquid flow in the flow path, and wherein the set of rotary fins are independent of the rotary shaft.

13. The method as recited in claim 12, further comprising rotating the AICD to generate centrifugal forces for discriminating between liquid and gas.

14. The method as recited in claim 13, wherein the AICD rotates at a different speed from the ESP.

15. A system comprising:

an electric submersible pump (ESP) configured for pumping fluid through a flow path; and an autonomous inflow control device (AICD) in fluid communication with the flow path configured to at least partially restrict one of gas or liquid flow in the flow path, wherein the AICD includes at least one float member and a valve opening, wherein the float member is connected to occlude the valve opening or unocclude the valve opening based on fluid density of fluid flowing through the AICD under centrifugal forces from rotation of the float member within the AICD.

16. The system as recited in claim 15, wherein the float member is configured to occlude the valve opening in the absence of gas within a housing of the AICD, impeding liquid flow through the valve opening, and to unocclude the valve opening in the presence of gas within the housing to vent gas through the valve opening and thereby divert the gas from the flow path and avoid gas lock interruption of the ESP.

17. The system as recited in claim 15, wherein the ESP includes an inlet in fluid communication with the flow path, and an outlet in the flow path downstream of the inlet, wherein the AICD is in the flow path upstream of the inlet.

18. The system as recited in claim 15, wherein the ESP includes an inlet in fluid communication with the flow path, and a discharge outlet in the flow path downstream of the inlet, wherein the AICD is in the flow path downstream of the outlet to remove gas or drop the pressure for gas relief.

19. A system comprising:

an electric submersible pump (ESP) configured for pumping fluid through a flow path; and an autonomous inflow control device (AICD) in fluid communication with the flow path configured to at least partially restrict one of gas or liquid flow in the flow path;

wherein the flow path is in a wellbore, wherein the ESP and flow path are connected to drive flow of production fluids from a formation in which the well bore is formed, to a surface of the wellbore;

wherein the wellbore includes the ESP therein, with a pump inlet in the flow path, with a dip tube extending from the pump inlet downward to an inlet of the dip tube below a liquid level in the well bore;

wherein the wellbore includes a headspace above the liquid level and below the pump inlet, wherein the AICD is positioned in the headspace, with an inlet of the AICD below an outlet of the AICD, wherein the AICD is configured to vent gas from the headspace to the surface through a bypass stream that bypasses the ESP, and to inhibit liquids entering the bypass stream; and wherein the AICD includes at least one float within a housing of the AICD, wherein the at least one float is configured to rotate about a rotation axis of the AICD which is aligned parallel to the wellbore.

20. The system as recited in claim 19, wherein the ESP includes an inlet in fluid communication with the flow path, and an outlet in the flow path downstream of the inlet, wherein the AICD is in the flow path upstream of the inlet.

21. The system as recited in claim 19, wherein the ESP includes an inlet in fluid communication with the flow path, and a discharge outlet in the flow path downstream of the inlet, wherein the AICD is in the flow path downstream of the outlet to remove gas or drop the pressure for gas relief.

22. A system comprising:

an electric submersible pump (ESP) configured for pumping fluid through a flow path, wherein the ESP includes a rotary shaft; and an autonomous inflow control device (AICD) comprising a set of rotary fins in fluid communication with the flow path configured to at least partially restrict one of gas or liquid flow in the flow path, wherein the AICD includes at least one float member and a valve opening, and wherein the set of rotary fins are exposed to the flow path for driving rotation of the AICD in response to fluid flow through the flow path, wherein the float member is connected to occlude the valve opening or unocclude the valve opening based on fluid density of fluid flowing through the AICD under centrifugal forces from rotation of the float member within the AICD, wherein the float member is configured to occlude the valve opening in the absence of gas within a housing of the AICD, impeding liquid flow through the valve opening, and to unocclude the valve opening in the presence of gas within the housing to vent gas through the valve opening and thereby divert the gas from the flow path and avoid gas lock interruption of the ESP, and wherein the AICD is independent of the rotary shaft.

23. The system as recited in claim 22, wherein the ESP includes an inlet in fluid communication with the flow path, and an outlet in the flow path downstream of the inlet, wherein the AICD is in the flow path upstream of the inlet.

24. The system as recited in claim 22, wherein the ESP includes an inlet in fluid communication with the flow path, and a discharge outlet in the flow path downstream of the inlet, wherein the AICD is in the flow path downstream of the outlet to remove gas or drop the pressure for gas relief.

25. A system comprising:

an electric submersible pump (ESP) configured for pumping fluid through a flow path, wherein the flow path is in a wellbore, wherein the ESP and flow path are connected to drive flow of production fluids from a formation in which the wellbore is formed, to a surface of the wellbore, wherein the wellbore includes the ESP therein, with a pump inlet in the flow path, with a dip tube extending from the pump inlet downward to an inlet of the dip tube below a liquid level in the well bore, wherein the wellbore includes a headspace above the liquid level and below the pump inlet, and wherein the ESP includes a rotary shaft; and an autonomous inflow control device (AICD) comprising a set of rotary fins in fluid communication with the flow path configured to at least partially restrict one of gas or liquid flow in the flow path, wherein the AICD is independent of the rotary shaft, wherein the set of rotary fins are exposed to the flow path for driving rotation of the AICD in response to fluid flow through the flow path; and wherein the AICD is positioned in the headspace, with an inlet of the AICD below an outlet of the AICD, wherein the AICD is configured to vent gas from the headspace to the surface through a bypass stream that bypasses the ESP, and to inhibit liquids entering the bypass stream, wherein the AICD includes at least one float within a housing of the AICD, and wherein the at least one float is configured to rotate about a rotation axis of the AICD which is aligned parallel to the wellbore.

* * * * *